US006103187A

United States Patent [19]

Kim et al.

[11] Patent Number: 6,103,187

[45] Date of Patent: Aug. 15, 2000

[54] PROCESS FOR THE PRODUCTION OF MULTILAYERED BULK MATERIALS

[75] Inventors: Byung-Geol Kim; Hee-Woong Lee, both of Kyongnam, Rep. of Korea

[73] Assignee: Korea Electrotechnology Research, Kyongnam, Rep. of Korea

[21] Appl. No.: 09/198,498

[22] Filed: Nov. 24, 1998

[30] Foreign Application Priority Data

Nov. 25, 1997 [KR] Rep. of Korea ..... 97-62714

[51] Int. Cl.[7] ..... B22F 3/12

[52] U.S. Cl. ..... 419/23; 419/38

[58] Field of Search ..... 419/23, 38

[56] References Cited

U.S. PATENT DOCUMENTS 4,761,263 8/1988 Politis et al. ..... 419/33

5,578,553 11/1996 Koriyama et al. ..... 505/125

5,997,273 12/1999 Laquer ..... 425/394

*Primary Examiner*—Daniel J. Jenkins

*Attorney, Agent, or Firm*—Arent Fox Kintner Plotkin & Kahn PLLC

[57] ABSTRACT

The present invention relates to a process of the production of multilayered bulk materials. A plurality of constituting powders of a desired multilayered material are mixed at a predetermined ratio, particle of the powders being smaller than 100 μm in size. The powder mixture is mechanically alloyed for a predetermined period of time by using a high-energy ball mill in an argon-filled glove box. The mechanically alloyed powder is loaded in a mold and is then hot-pressed under a uniaxial compressive pressure at a predetermined temperature, resulting in a composition having multilayered structure. The process according to the present invention provides an effective way of overcoming thickness limitations of conventional multilayered materials and enabling low-cost mass production of multilayered materials.

4 Claims, 2 Drawing Sheets

20 μm

PROCESS FOR THE PRODUCTION OF MULTILAYERED BULK MATERIALS

BACKGROUND OF THE INVENTION

1. Field of the Invention

The present invention relates generally to a process for producing multilayered bulk material. More specifically, it relates to a production method of multilayered bulk materials, based on a combined technique of mechanically alloying and subsequent hot pressing, by which the thickness and interlayer distance of the layer structure can be chosen as thick as possible.

2. Brief Description of the Related Art

The anisotropy—physical properties change with the direction along which a measurement is made—is one of intrinsic properties of multilayered materials. Due to the property, multilayered materials have attracted much attention from industry and academic side.

Physical properties of a material are generally dependent on whether the material is in the shape of two-dimension or three-dimension. Each layer of a multilayered material has its different characteristics, depending on its thickness. Based on the characteristics of each layer, the multilayered material has peculiar characteristics compared to non-multilayered materials.

Anisotropy of the physical properties according to whether the direction is vertical or horizontal, is one of unique properties of a mutlilayered materials. Because of the property, multilayered materials have been used as multi-functional materials. Therefore, it is expected that multilayered materials will be sources for new materials having desired multi-functions, which has been impossible to achieve with non-multilayered materials.

In prior art methods, multilayered materials are prepared by means of evaporation, sputtering, or iodine vapor transport reaction, but these processes are subject to thickness limitations, i.e., individual layers are thin films of submicron (less than about 100~300 Å in thickness)

In the case of both evaporation and sputtering, which are kinds of physical vapor deposition (PVD) where constituting atoms are deposited on a substrate, individual layers are generally less than about 100~300 Å, and the production cost is high.

The method of iodine-transport reaction has limited applicability in that it can be applied only to a particular class of organic metals. In addition to high production cost, the method is also subject to thickness limitation (less than 10~30 Å). The prior art processes for making multilayered materials are subject to several limitations including thickness, thereby causing many practical problems.

SUMMARY OF THE INVENTION

A general objective of the present invention is to solve the above mentioned problems and to provide a production method of multilayered bulk materials that enables to make individual layers thicker than those of prior art processes.

The production method for multilayered bulk materials according to the present invention is characterized in that it comprises the steps of mixing powders of constituents at a predetermined ratio needed to form a desired; milling the powder mixture to mechanically-alloy the powder mixture for a predetermined period of time; and hot pressing the mechanically alloyed powder mixture contained in a mold for a predetermined period of time under a uniaxial compressive pressure.

The production method according to the present invention solves application problems of conventional multilayered thin materials because individual layers can be made in the bulky form and enables low-cost mass production.

In addition, the present invention makes it possible to produce multi-functional materials by offering an effective way of producing materials having anisotropic characteristics and controlling the anisotropy. Hence, the present invention can be applied to the production of materials that are used for components or sensors for a variety of high-tech products.

BRIEF DESCRIPTION OF THE DRAWINGS

The accompanying drawings, which are included to provide a further understanding of the invention, illustrate preferred embodiments of this invention, and together with the description, serve to explain the principles of the present invention.

In the drawings.

DETAILED DESCRIPTION OF THE PREFERRED EMBODIMENTS

Figure 1:
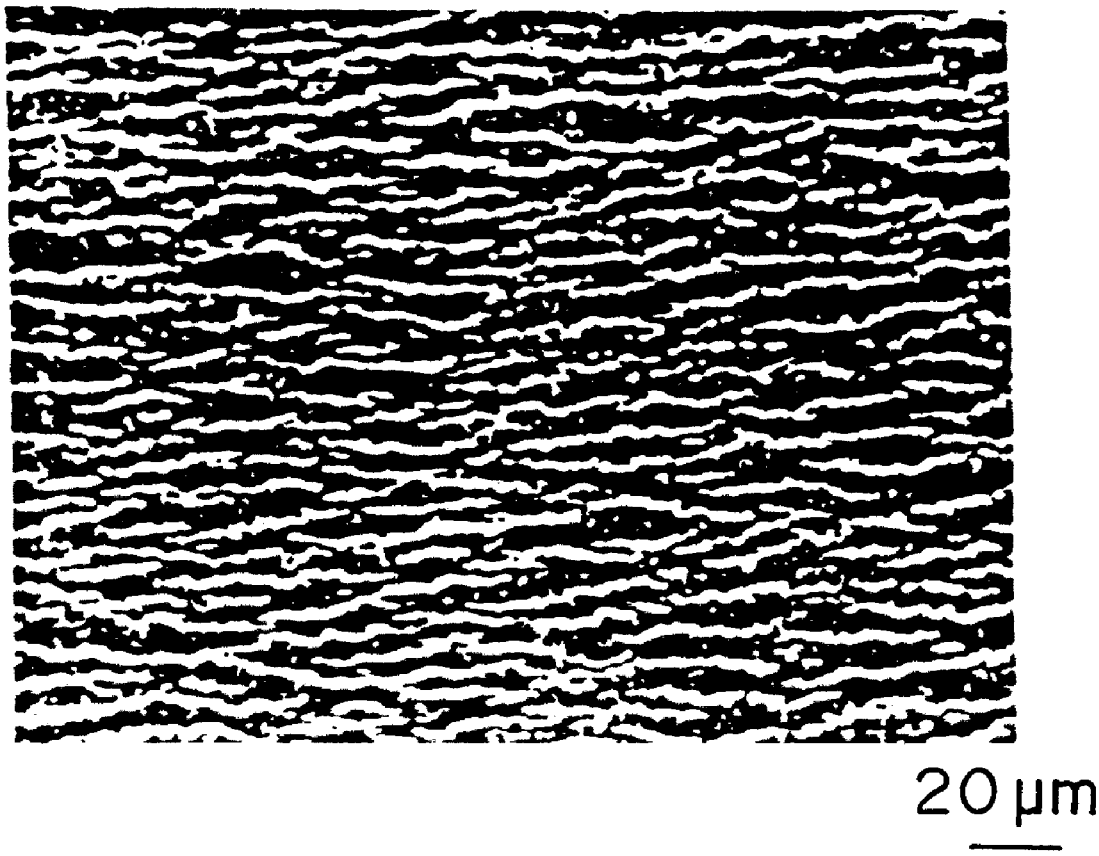
FIG. 1 is an optical micrograph showing a vertical cross-section of a multilayered material obtained by way of the process in accordance with the present invention.

The preferred embodiment of the present invention will be described in detail referring to the accompanying drawings.

The first step of the production method according to the present invention is to mix a plurality of powders of constituents of a desired composition at a predetermined ratio, particle of powders being smaller than 100 $\mu$m in size. The constituents and the atomic ratio in the powder mixture are determined according to formation of the desired.

The second step is milling the powder mixture for a period of time by using a high-energy ball mill to mechanically alloy the powder mixture. An appropriate amount of the powder mixture is loaded into a ball-mill container with balls in an environment where external air is prevented from being in-flowed.

The reason why no inflow of external air is permitted is as follows. In ball milling, powders get fractured as they collide with balls repeatedly, new surfaces of the powders being formed. Atoms on the newly generated surfaces of the powders are in the highly activated state. Hence, if external air exists in the ball-mill container, the surface atoms react to oxygen in the air and thus thin layers of a metal oxide are formed on the surfaces, resulting in the interference of mechanically alloying of the powders.

It is desirable to use a ball-mill container and balls that are made of a hard material in order to inhibit impurities that may be generated by collision between balls or between balls and the ball-mill container.

Additionally, it is preferable to use a ball-mill container and balls which are made of a heavy material to shorten the time required for mechanically alloying process. This is because the extent of interaction between powders in ball milling depends on materials of the container and balls and the rotational speed of the container. Given that the material of the container and the rotational speed are identical, the degree of interaction between powders depends on the material of balls or the magnitude of kinetic energy of balls.

In other words, when balls and powders collide to each other, kinetic energy of balls is transmitted to the powder, and the interaction between the powders is accelerated in proportion to the impulse energy the powders have. On the other hand, the kinetic energy of balls is proportional to the mass of balls. Hence, the heavier the balls are, the shorter the time required for mechanically alloying of the powders is.

The ball mass to powder mass ratio is also one of important parameters of ball-milling, but a reliable guidance of the mass ratio is not available yet. On the other hand, it is preferred that the mechanically alloying process is maintained until each alloyed powders becomes in planar shape as much as possible.

The third, final step of the production method according to the present invention is to load an appropriate amount of the mechanically alloyed powder mixture into a mold and to form the powder mixture into a multilayered bulk composition by hot pressing at an appropriate temperature for a predetermined period of time under a uniaxial compressive pressure.

In order to selectively melt the constituting powder to build up the layered structure, it is preferred that the temperature of the furnace used in the hot-pressing process is chosen such that it is higher than the melting temperature of the powder, Tm, but less than 1.1*Tm. As a result, the molten powder comes to grow in the direction perpendicular to the uniaxial compressive pressure, leading to a multilayered material.

In order to more fully illustrate the present invention, the following example is provided concerning the production of a multilayered composition having superconducting properties.

EXAMPLE

A $SiO_2$ powder (99.99%), a Pb powder (99.9%), and a Bi powder (99%) were prepared and mixed to give desired compositions of $(SiO_2)_{100-X}(Pb_{0.6}Bi_{0.4})_X$ (X=20~80 at. %). The three powders had particles smaller than 100 $\mu$m. The powder mixture was loaded into a cylindrical Co-bonded tungsten carbide ball-mill container with tungsten balls with a weight ratio of balls to the powder mixture of 30:1. All mixing and handling of the powders were done in an argon-filled glove box.

The powder mixture was milled at 1,500 RPM for 1 hour by using a planetary ball mill, one of representative high-energy ball mills in which the container's revolution and rotation can be made simultaneously.

Then, an appropriate amount of the mechanically alloyed powder mixture was loaded in a maraging steel mold and then formed into a composition by hot pressing at 473 K for 30 minutes under a uniaxial compressive pressure of 250 MPa.

Because the melting temperature of $Pb_{60}Bi_{40}$ alloy, which forms the layered structure, is 453 K, the temperature of the furnace at hot-pressing was set to 473 K, higher than the melting temperature by 20 K. Consequently, $Pb_{60}Bi_{40}$ alloy was melt selectively at the hot-pressing temperature and thus was grown in the direction perpendicular to the uniaxial compressive pressure. In this way, a desired multilayered material was obtained.

FIG. 1 is an optical micrograph showing a vertical cross-section (with respect to the direction of the pressure applied) of $(SiO_2)_{50}(Pb_{0.6}Bi_{0.4})_{50}$ compact, which had the clearest layered structure among those obtained from several experiments. It is evident from FIG. 1 that the resultant compact had a typical multilayered structure.

By various examinations of the $(SiO_2)_{50}(Pb_{0.6}Bi_{0.4})_{50}$ compact, it turned out that the dark areas in the photograph corresponds mainly to $SiO_2$ and the brighter areas corresponds mainly to $\epsilon$ (Pb—Bi) phase. This implies that some amount of $\epsilon$ (Pb—Bi) phase, which was developed in the step of mechanical alloying, was molten and grown in the direction perpendicular to the uniaxial applied pressure in the hot-pressing.

The formation of the layered structure of the compact was observed clearly at X=40, 50, 60%. At X=50%, the compact had the most well-developed layered structure. The average thickness and interlayer distance of the $\epsilon$ (Pb—Bi) layer were 1.5 $\mu$m and 7 $\mu$m, respectively.

Figure 2:
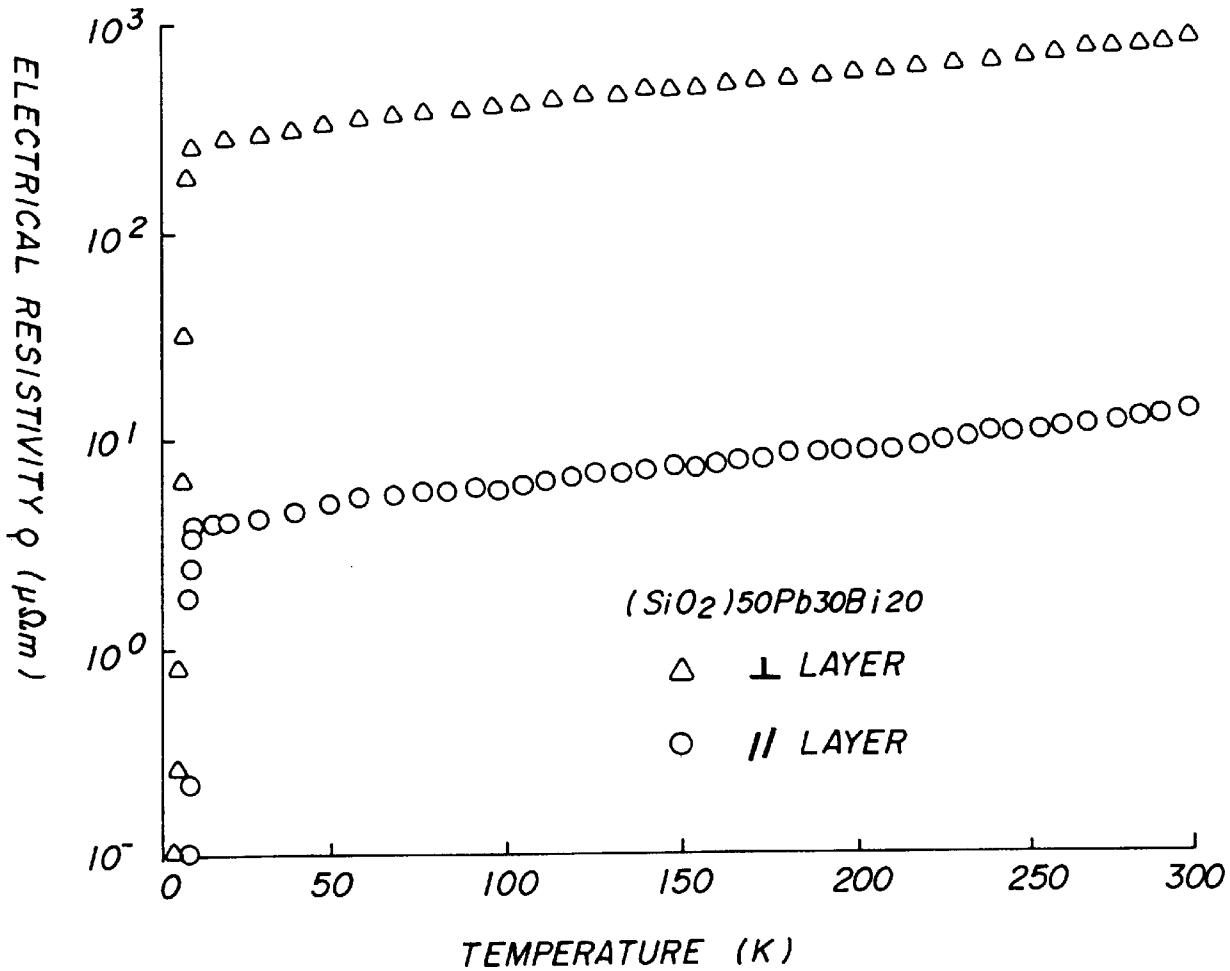
FIG. 2 is a graph showing the temperature dependence of electrical resistivity for the material of FIG. 1.

FIG. 2 is a graph showing the electrical resistivity of the compact of FIG. 1 measured along the directions which are parallel and perpendicular to the layer structure at temperatures ranging from 4.2 K to 300 K. A significant difference between the electrical resistivity for the both directions was observed.

Both $\epsilon$ (Pb—Bi) phase and Pb have superconducting properties, and thus the electrical resistance of $(SiO_2)_{50}(Pb_{0.6}Bi_{0.4})_{50}$ compact decreases gradually as temperature is lowered, but drops to zero abruptly with the approach to a critical temperature.

While the electrical resistance measured along the parallel direction become zero when temperature was 8.5 K, the electrical resistance measured along the perpendicular direction become zero at 6.9 K. This indicates that there exists a considerable difference between the degrees of the superconducting coupling of the both directions.

When temperature was 10 K, the electrical resistivity ($\rho_{10}$) for the parallel and perpendicular directions were 5.1$\mu$ $\Omega$m and 420$\mu$ $\Omega$m, respectively. The resistivity ($\rho_{300}$) at 300 K was 10.5$\mu$ $\Omega$m for the parallel direction and 947$\mu$ $\Omega$m for the perpendicular direction. This high anisotropy of the resisitivity could be achieved only with the $(SiO_2)_{50}(Pb_{0.6}Bi_{0.4})_{50}$ compact having a layered structure of the present invention.

The foregoing is provided only for the purpose of illustration and explanation of the preferred embodiments of the present invention, so changes, variations and modifications may be made without departing from the spirit and scope of the invention.

What is claimed is:

1. A method of producing a multi-layered bulk material, comprising the steps of:

(a) mixing powders of $SiO_2$ (99.99%), Pb (99.9%) and Bi (99%) whose particles are smaller than 100 $\mu$m into compositions of $(SiO_2)_{100-X}(Pb_{0.6}Bi_{0.4})_X$, where X is between 20 and 80;

(b) loading the powder mixture and tungsten balls into a cylindrical Co-bonded tungsten carbide ball-mill container with a weight ratio of the balls to the powder mixture of 30:1;

(c) milling the powder mixture at 1500 rpm for about 1 hour with a planetary ball milling apparatus; and (d) hot-pressing the milled powder mixture at 473 K for about 30 minutes under a uniaxial compressive pressure of 250 Mpa, so as to produce a multi-layered bulk material.

2. A method according to claim 1, wherein the powder mixture is loaded into the tungsten ball-mill container in an airtight box filled with an inert gas.

3. A method according to claim 1, wherein said step (c) comprises milling the powder mixture until the powders to be mechanically alloyed come to in the form of planar shape.

4. A method according to claim 1, wherein said step (d) comprises pressing the milled powder mixture at 1.1 times a melting temperature of the powders.

* * * * *